US007931161B2

(12) United States Patent
Newbould et al.

(10) Patent No.: US 7,931,161 B2
(45) Date of Patent: Apr. 26, 2011

(54) WALL MOUNTABLE WIRE GRID ORGANIZER SYSTEM WITH REMOVABLE ACCESSORIES

(75) Inventors: Peter J. Newbould, Milan (IT); Ivana Babic, Milan (IT); Craig Thompson, Inver Grove Heights, MN (US); Russell G. Pihlstrom, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 534 days.

(21) Appl. No.: 11/849,412

(22) Filed: Sep. 4, 2007

(65) Prior Publication Data

US 2008/0053932 A1 Mar. 6, 2008

Related U.S. Application Data

(60) Provisional application No. 60/842,452, filed on Sep. 6, 2006.

(51) Int. Cl.
*A47F 5/08* (2006.01)

(52) U.S. Cl. ..... 211/106; 211/85.31; 211/119.009; 211/181.1

(58) Field of Classification Search ..... 211/119, 211/181.1, 90.03, 106, 112, 119.009, 106.01, 211/70.6, 85.31; 223/85; D6/458, 462
See application file for complete search history.

(56) References Cited

U.S. PATENT DOCUMENTS

| | | | | |
|---|---|---|---|---|
| 694,793 | A * | 3/1902 | Schiele | 211/106 |
| 1,421,709 | A * | 7/1922 | Nelson | 211/119 |
| 2,196,663 | A * | 4/1940 | Isele | 118/500 |
| 3,178,033 | A * | 4/1965 | Wirsing | 211/119.009 |
| 3,659,722 | A * | 5/1972 | Carroll | 211/106 |
| 4,024,312 | A | 5/1977 | Korpman | |
| 4,108,314 | A | 8/1978 | Racca | |
| 4,969,580 | A | 11/1990 | Mikhail | |
| 5,255,401 | A | 10/1993 | Sambrookes et al. | |
| 5,289,927 | A | 3/1994 | Emery | |
| 5,507,464 | A * | 4/1996 | Hamerski et al. | 248/683 |
| 5,516,581 | A | 5/1996 | Kreckel et al. | |
| 5,588,543 | A * | 12/1996 | Finger | 211/90.01 |
| 5,620,105 | A * | 4/1997 | Macek | 211/119 |
| 5,887,731 | A * | 3/1999 | Thalenfeld | 211/57.1 |
| 6,106,937 | A * | 8/2000 | Hamerski | 428/343 |
| 6,131,864 | A * | 10/2000 | Schumann | 248/205.3 |
| 6,231,962 | B1 | 5/2001 | Bries et al. | |

(Continued)

FOREIGN PATENT DOCUMENTS

DE 33 31 016 C2 7/1992

(Continued)

OTHER PUBLICATIONS

Search Report, Singapore Application No. 200901481-2 (PCT/US2007/077546), Aug. 19, 2010, 6 pages.

*Primary Examiner* — Darnell M Jayne
*Assistant Examiner* — Stanton L Krycinski
(74) *Attorney, Agent, or Firm* — Kenneth B. Wood

(57) ABSTRACT

A wall mountable wire grid organizer rack assembly includes a support grid structure including a perimeter frame and a plurality of transverse support members connected with the perimeter frame. A plurality of accessories are removably connected with the support members, and at least one stretch removable adhesive strip is arranged between the support grid and the wall for securing the rack to the wall.

20 Claims, 1 Drawing Sheet

U.S. PATENT DOCUMENTS

| | | | | |
|---|---|---|---|---|
| 6,257,421 | B1 * | 7/2001 | Outten | 211/40 |
| 6,520,351 | B1 | 2/2003 | Zadro | |
| 6,541,089 | B1 | 4/2003 | Hamerski et al. | |
| 6,569,521 | B1 | 5/2003 | Sheridan et al. | |
| 6,641,910 | B1 | 11/2003 | Bries et al. | |
| 6,811,126 | B2 * | 11/2004 | Johansson et al. | 248/205.3 |
| 6,972,141 | B1 | 12/2005 | Bries et al. | |
| 7,078,093 | B2 | 7/2006 | Sheridan et al. | |
| 7,540,456 | B2 * | 6/2009 | Thompson | 248/205.3 |

FOREIGN PATENT DOCUMENTS

| | | | |
|---|---|---|---|
| EP | 197870 | A1 * | 10/1986 |
| FR | 1335491 | A | 7/1963 |
| GB | 2137491 | | 10/1984 |
| JP | 6-29483 | | 2/1994 |
| JP | 2002-482 | | 1/2002 |
| JP | 2002/000482 | A | 1/2002 |
| JP | 3107337 | U | 12/2004 |
| KR | 92-14685 | | 8/1992 |

* cited by examiner

WALL MOUNTABLE WIRE GRID ORGANIZER SYSTEM WITH REMOVABLE ACCESSORIES

CROSS REFERENCE TO RELATED APPLICATION

This application claims the benefit of U.S. Provisional Patent Application No. 60/842,452, filed Sep. 6, 2006, the disclosure of which is incorporated by reference herein in its entirety.

TECHNICAL FIELD

The present invention relates generally to wall mountable storage and organizing articles and, more particularly, to a wire form shelf assembly that can be adhesively mounted to, for example, a vertical wall surface in a bathroom or the interior surface of a bath or shower enclosure to hold a variety of items commonly used in the bathroom or shower.

BACKGROUND

Shower and bath storage devices, often referred to as shower or bath caddies, are commonly used to hold and/or store items such as soap, shampoo, and other bath items in shower and bath enclosures. Because of the weight of the stored items and because it is generally not practical to mount such items in shower or bath enclosures using mechanical fasteners, such as nails and screws, such devices are typically hung from the shower nozzle fixture. Such devices are known in the prior art. U.S. Pat. No. 4,969,580 (Mikhail Essatt), U.S. Pat. No. 4,108,314 (Racca), U.S. Pat. No. 5,255,401 (Sambrookes et al.), and U.S. Pat. No. 6,520,351 (Zadro), for example, disclose such devices. It is also known to mount such devices using suction cups as disclosed in, for example, U.S. Pat. No. 5,289,927 (Emery).

Such devices, however, suffer from certain drawbacks and shortcomings. Devices that hang from the shower nozzle fixture, for example, tend to be large and cumbersome and because such devices must hang down from the shower nozzle fixture below the shower head so the items in the caddy can be accessed by a user, they are unstable and tend to swing sideways or slide off of the shower nozzle fixture. In addition, the mounting location is limited by the location of the shower nozzle fixture such that they cannot be moved, and, because they must be mounted immediately below the shower head, they tend to interfere with the use of the shower. Devices mounted with suction cups, on the other hand, have limited holding capacity and tend to lose their holding ability over time. As a result, devices mounted with suction cups frequently fail, thereby causing the device and its contents to fall off the wall. The need therefore exists for a storage device that can be adhesively mounted to the wall surface of a shower or bath enclosure that is inexpensive, easy to install, is adjustable, and holds strongly enough to support items commonly stored in such devices.

The need therefore exists for a storage device that can be adhesively mounted to the wall surface of a shower or bath enclosure that is inexpensive, easy to make and use, is adjustable and versatile, and holds strongly enough to support items commonly stored in such devices.

SUMMARY

The invention overcomes the above-identified limitations in the field by providing an organizer rack assembly that can be adhesively mounted to, for example, the wall surface of a shower or bath enclosure, that is inexpensive, easy to install, and holds strongly enough to support items commonly stored in such devices.

In one embodiment, the present invention provides a wall mountable organizer rack assembly including a support grid structure including a perimeter frame and a plurality of transverse support members connected with the perimeter frame, at least one accessory removably connected with the support members, and at least one stretch removable adhesive strip arranged between the support grid and the wall for adhesively bonding the rack to the wall. In one aspect, the present invention provides a rack including at least one back plate connected with the support grid to which at least one stretch removable adhesive strip is adhered.

In a specific aspect, the back plates have generally planar surfaces facing the wall and the at least one stretch removable adhesive strip is arranged on the back plate planar surface. In another aspect, the support members comprise a looped mounting rod comprising a pair of spaced generally parallel rod portions. One rod portion is connected with a back plate and the other rod is connected with the perimeter frame. In this manner, the looped mounting rod serves to maintain the perimeter frame in spaced relation from the wall.

BRIEF DESCRIPTION OF DRAWINGS

The present invention will be further described with reference to the accompanying drawings, in which.

DETAILED DESCRIPTION

Figure 1:
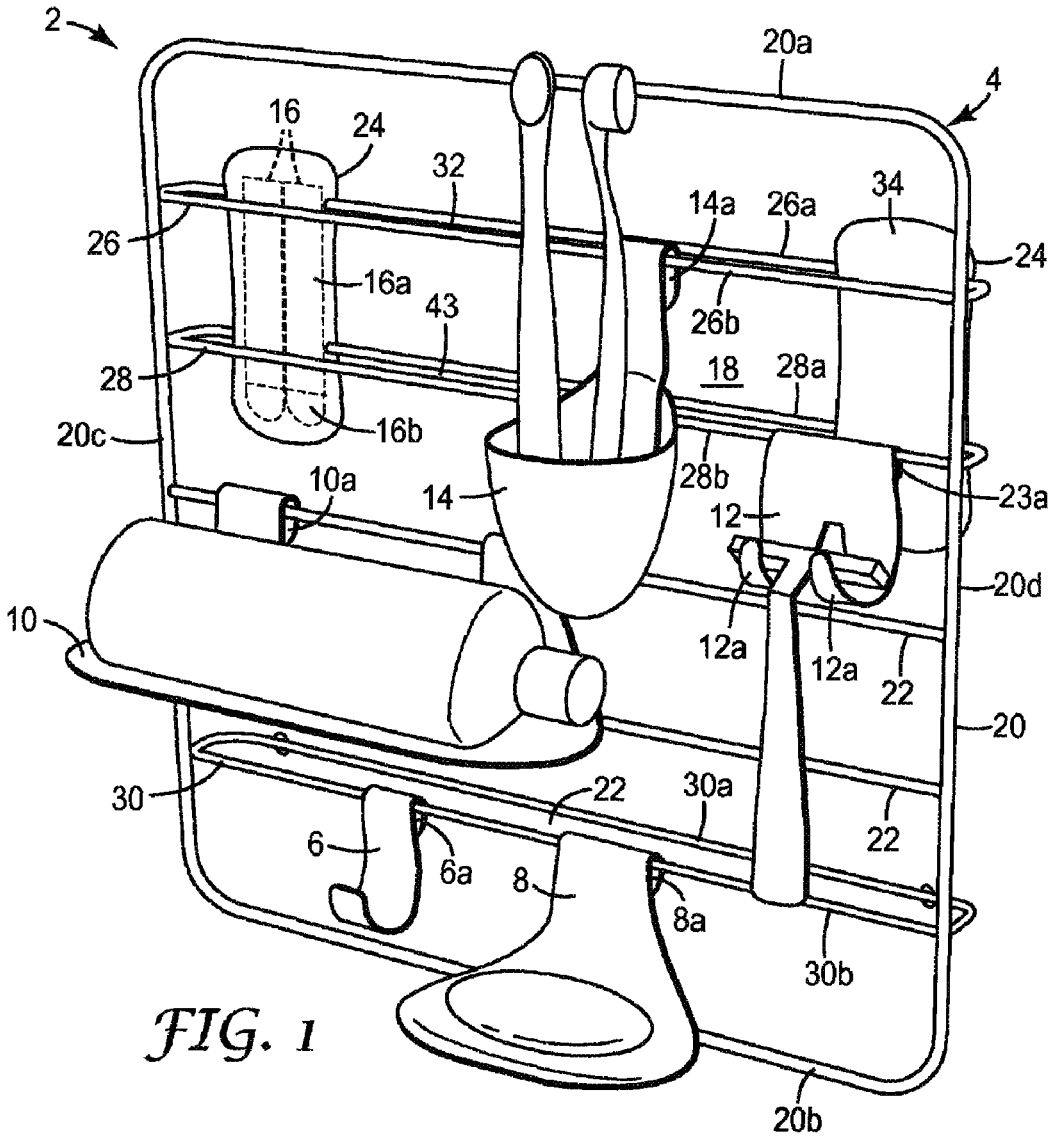
FIG. 1 is a perspective view of a wall mountable wire grid rack assembly with removable accessories.
Figure 2:
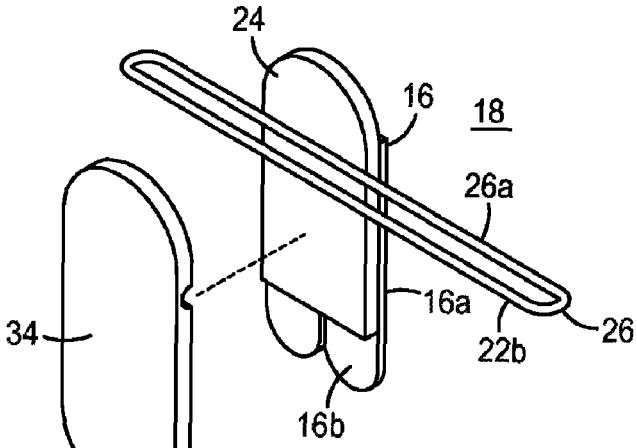
FIG. 2 is partially exploded detailed view showing how the wire grid rack assembly is mounted on a wall surface.

Referring now to the drawings, wherein like reference numeral refer to like or corresponding parts throughout, FIGS. 1 and 2 show a wall mounted wire grid rack assembly 2 for holding items such as soap, shampoo and the like in, for example, a shower or bath enclosure. The rack 2 includes a support grid structure 4, a plurality of accessories 6,8,10,12,14 removably connected with the support grid structure 4, and stretch removable adhesive strips 16 arranged to adhesively bond the grid structure 4 to a wall surface 18.

The support grid structure 4 includes a perimeter frame 20 and a plurality of transverse support members 22 connected with the perimeter frame 20. The perimeter frame 20 includes a top rail portion 20*a*, a bottom rail portion 20*b* and opposed side rail portions 20*c*,20*d* extending from the top 20*a* to the bottom 20*b* rail portions. In the illustrated embodiment, the support members 22 comprise horizontal rods extending from one side rail 20*c* to the opposite side rail 20*d* portion.

In the illustrated embodiment, the rack 2 includes back plates 24 connected with the support grid 4. The back plates 24 have generally planar surfaces facing the wall surface 18 to which the stretch removable adhesive strips 16 are affixed, thereby to adhesively bond the support grid 4 to the wall surface 18.

In the illustrated embodiment, the grid structure 4 includes three looped mounting rods 26,28,30 that serve to space the frame 20 from the wall surface 18 and serve as support members for one or more of the accessories 6,8,10,12,14. Each looped mounting rod 26,28,30 comprises a pair of spaced generally parallel rod portions 26*a*,*b*, 28*a*,*b* 30*a*,*b*. Referring to looped rod 26, one rod portion 26*a* is connected with a back plate 24, and the other rod portion 26*b* is connected with the perimeter frame 20, whereby the looped mounting rod 26 serves to maintain the perimeter frame 20 in spaced relation from the wall surface 18. The other rod portion 26*b* serves as a support member to which accessories may be attached. In this manner, the rearward portion of the mounting rods 26*a*, 28*a*,30*a* is arranged adjacent the wall surface, and the forward portion of the mounting rods 26*b*,28*b*,30*b* is arranged in spaced relation with the wall surface 18 and serves as a support to which accessories 6,8,10,12,14 may be secured.

In the illustrated embodiment, the two upper looped mounting rods 26,28 extend between the side rail portions 20*c* near the top rail portion 20 and are connected with the back plates 24, and the lower looped mounting rod 30 extends between the side rail portions 20*c* near the bottom rail portion 20*b*. The two support members 22 arranged between looped mounting rods 28,30 are single rods that extend between the side rail portions 20*c*,20*d* and serve to support accessories.

In the illustrated embodiment, each accessory 6,8,10,12,14 includes a curved end portion 6*a*,8*a*,10*a*,12*a*,14*a* that fits over either one of the support rods 22 or the forward portion 26*b*,28*b*,30*b* of one of the looped mounting rods 26,28,30. In the case of the looped mounting rods 26,28,30, the forward and rear rods are spaced to define an elongated opening 32 through which the end portion 6*a*,8*a*,10*a*,12*a*,14*a* of the associated accessory 6,8,10,12,14 may extend.

In the illustrated embodiment, accessory 6 is a unitary hook attached to the lower most looped mounting rod 30. Accessory 8 is a unitary tray configured to hold a bar of soap Accessory 10 is a unitary shelf structure designed to hold, for example, a bottle of shampoo or conditioner. Accessory 12 is a unitary hook including a pair of spaced raised regions 12*a* defining a recessed region there between configured to hold a conventional razor. And accessory 14 is a cup shaped article designed to hold, for example, tooth brushes.

As shown in broken lines in FIG. 1, stretch removable adhesive strips 16 are arranged between the back plate 24 and the wall surface 18, and thereby adhesively bond the rack 2 to the wall surface 18. A suitable stretch removable adhesive is the double-sided stretch removable adhesive strips available from 3M Company, St. Paul, Minn. under the COMMAND trade designation. Commercially available COMMAND adhesive strips are currently manufactured as discrete strips with one end of the strip including a non-adhesive pull tab to facilitate stretching of the strip during removal.

Stretch removable adhesives are high performance pressure-sensitive adhesives that combine strong holding power with clean removal and no surface damage. The double-sided adhesive strips 16 may be any conventionally known stretch removable adhesive tape including a stretch removable adhesive tape with an elastic backing, a stretch removable adhesive tape with a highly extensible and substantially inelastic backing, or a stretch removable adhesive tape comprising a solid elastic pressure sensitive adhesive, but are preferably stretch removable adhesive strips that are moisture resistant (i.e. they maintain their holding power in the presence of water and/or in high humidity environments).

Specific tapes suitable for use in the various embodiments of the present invention include the pressure sensitive adhesive tapes with elastic backings described in U.S. Pat. No. 4,024,312 (Korpman), the pressure sensitive adhesive tapes with highly extensible and substantially inelastic backings described in U.S. Pat. Nos. 5,516,581 (Kreckel et al.) and 6,231,962 (Bries et al.), 6,569,521 (Sheridan et al.), 7,078,093 (Sheridan et al.), and the solid elastic pressure sensitive adhesive described in German Patent No. 33 31 016. Other suitable stretch removable adhesive constructions include the stretch removable adhesive tape laminate including a separable fastener described in U.S. Pat. No. 6,972,141 (Bries et al.), and the elongate stretch removable tape constructions described in U.S. Pat. Nos. 6,641,910 (Bries et al.), and 6,541,089 (Hamerski et al.).

The stretch removable adhesive strips 16 include an adhesive portion 16*a*, which is typically concealed by the back plate 24 when the back plate 24 is mounted to the wall surface 18, and a non-adhesive pull tab portion 16*b* that extends outwardly beyond the bottom of the back plate 24 as shown in FIG. 2. In the illustrated embodiment, the rack 2 further includes an optional cover plate 34 arranged over the back plate 24. When the cover plate 34 is assembled over the back plate 24, it serves to conceal the non-adhesive pull tab portions 16*b* of the stretch removable adhesive strips 16, but, when removed from the back plate 24, the non-adhesive pull tabs 16*b* are visible and may be readily accessed by a user wishing to stretch remove the adhesive strips 16 from the wall surface 18.

If the adhesive strips 16 include a separable fastener, such as is described in U.S. Pat. No. 6,972,141 (Bries et al.), the adhesive strips 16 may be arranged such that both the adhesive portion 16*a* and the non-adhesive pull tab portion 16*b* of the adhesive strip may be concealed by the back plate 24. This is possible because each adhesive strip can be removed by first separating the adhesive strip via the separable fastener and then stretch removing each remaining half from its respective surface. In this case, the cover plate 34 may be omitted.

The support rack 4, including the perimeter frame 20, the support members 22 and the looped mounting rods 26,28,30, is typically formed of metal rods, such as vinyl coated metal rods, but may be formed of any suitable material such as an injected molded synthetic plastic material. The accessories 6,8,10,12,14 are typically formed of injected molded synthetic plastic material but may be formed of any suitable material including metals. The back plate 24 and cover plate 34 may also be formed of metals and/or synthetic plastic materials.

Persons of ordinary skill in the art may appreciate that various changes and modifications may be made to the invention described above without deviating from the inventive concept. For example, it will be recognized that although the rack 2 is illustrated as being mounted with two back plates 24 each having two adhesive strips 16, one or more such mounting plates and adhesive strips may be used. In addition, it will be recognized that the rack 2 may be provided with any practical number of support members 22. Thus, the scope of the present invention should not be limited to the structures described in this application, but only by the structures described by the language of the claims and the equivalents of those structures.

What is claimed is:

1. A wall mountable organizer rack assembly, comprising:

(a) a support grid structure including a perimeter frame and a plurality of transverse support members connected with the perimeter frame;

(b) at least one accessory removably connected with the support members; and (c) at least one stretch removable adhesive strip arranged between the support grid and the wall for securing the rack to the wall;

(d) wherein the plurality of transverse support members includes a first looped mounting rod formed as a continuous loop and extending from the perimeter frame toward the wall, wherein the first looped mounting rod is configured to maintain the perimeter frame in a spaced relation from the wall;

wherein the rack assembly further includes at least one back plate connected with the support grid, the at least one back plate having a generally planar surface facing the wall and further wherein the at least one stretch removable adhesive strip is arranged on the back plate planar surface; and wherein the plurality of transverse support members further includes a second looped mounting rod arranged parallel to, and vertically spaced from, the first looped mounting rod, and further wherein the at least one back plate is mounted to the first and second looped mounting rods.

2. A rack as defined in claim 1, wherein the frame includes a top rail portion, a bottom rail portion, and first and second opposed side rail portions extending from the top rail portion to the bottom rail portion.

3. A rack as defined in claim 2, wherein the support members comprise support rods extending from the first side rail portion to the second side rail portion.

4. A rack as defined in claim 1, wherein the first looped mounting rod defines a pair of spaced generally parallel rod portions, one rod portion being connected with the at least one back plate and the other rod portion being connected with the perimeter frame.

5. A rack as defined in claim 4, wherein the frame includes a top rail portion, a bottom rail portion, and opposing side rail portions, and further wherein the first looped mounting rod extends between the side rail portions near the top rail portion, and the second looped mounting rod extends between the side rail portions near the bottom rail portion.

6. A rack as defined in claim 4, wherein the frame includes a top rail portion, a bottom rail portion, and opposing side rail portions, and further wherein the second looped mounting rod extends between the side rail portions and is connected with the at least one back plate.

7. A rack as defined in claim 1, wherein the accessory includes a curved end portion configured to support the accessory from a support rod.

8. A rack as defined in claim 1, wherein the accessory is a unitary hook.

9. A rack as defined in claim 1, wherein the accessory is a unitary shelf structure.

10. A rack as defined in claim 1, wherein the accessory is a unitary tray configured to hold a bar of soap.

11. A rack as defined in claim 1, wherein the accessory is a unitary hook including a pair of spaced raised regions defining a recessed region there between configured to hold a conventional razor.

12. A rack as defined in claim 1, wherein the stretch removable adhesive strip is a double-sided adhesive strip including a non-adhesive pull tab at one end, and wherein the rack is configured such that when the back plate is mounted on a vertical wall surface, the non-adhesive pull tab extends outwardly beyond the end of the back plate and accessible to a user wishing to stretch remove the adhesive strip from the wall surface.

13. A rack as defined in claim 12, further comprising a cover plate removably connected with the back plate, wherein the rack is configured such that when the cover plate is connected with the back plate, the cover plate conceals the non-adhesive pull tab portion of the stretch removable adhesive strip.

14. A rack as defined in claim 1, wherein the support grid structure is formed of metal rods and the accessory is formed of an injected molded synthetic plastic material.

15. A rack as defined in claim 1, wherein the at least one back plate comprises two back plates, and further wherein each of the two back plates is connected to the first looped mounting rod.

16. A rack as defined in claim 1, wherein in an upright orientation of the rack, the first looped mounting rod is above the second looped mounting rod, and further wherein the at least one stretch removable adhesive strip includes a non-adhesive pull tab portion at a leading end opposite a trailing end, and even further wherein the at least one stretch removable adhesive strip is arranged relative to the corresponding back plate such that in the upright orientation of the rack, the trailing end is vertically above the first looped mounting rod and the non-adhesive pull tab portion is vertically below the second looped mounting rod.

17. A rack as defined in claim 13, wherein the cover plate forms a notch configured to receive a portion of the support grid otherwise connected to the corresponding back plate upon assembly of the cover plate to the back plate.

18. A rack as defined in claim 1, wherein the support grid structure and the at least one accessory is formed of an injected molded synthetic plastic material.

19. A wall mountable organizer rack assembly, comprising:

(a) a support grid structure including a perimeter frame and a plurality of transverse support members connected with the perimeter frame;

(b) at least one accessory removably connected with the support members; and (c) at least one stretch removable adhesive strip arranged between the support grid and the wall for securing the rack to the wall;

(d) wherein the plurality of transverse support members includes a first looped mounting rod formed as a continuous loop and extending from the perimeter frame toward the wall, wherein the first looped mounting rod is configured to maintain the perimeter frame in a spaced relation from the wall;

wherein the rack assembly further includes at least one back plate connected with the support grid, the at least one back plate having a generally planar surface facing the wall and further wherein the at least one stretch removable adhesive strip is arranged on the back plate planar surface;

wherein the first looped mounting rod defines a pair of spaced generally parallel rod portions, one rod portion being connected with the at least one back plate and the other rod portion being connected with the perimeter frame;

and wherein the frame includes a top rail portion, a bottom rail portion, and opposing side rail portions, and further wherein the support members comprise a second looped mounting rod extending between the side rail portions and connected with the at least one back plate.

20. A wall mountable organizer rack assembly, comprising:

(a) a support grid structure including a perimeter frame and a plurality of transverse support members connected with the perimeter frame;

(b) at least one accessory removably connected with the support members; and (c) at least one stretch removable adhesive strip arranged between the support grid and the wall for securing the rack to the wall;

(d) wherein the plurality of transverse support members includes a first looped mounting rod formed as a continuous loop and extending from the perimeter frame toward the wall, wherein the first looped mounting rod is configured to maintain the perimeter frame in a spaced relation from the wall;

wherein the rack assembly further includes at least one back plate connected with the support grid, the at least one back plate having a generally planar surface facing the wall and further wherein the at least one stretch removable adhesive strip is arranged on the back plate planar surface;

wherein the stretch removable adhesive strip is a double-sided adhesive strip including a non-adhesive pull tab at one end, and wherein the rack is configured such that when the back plate is mounted on a vertical wall surface, the non-adhesive pull tab extends outwardly beyond the end of the back plate and accessible to a user wishing to stretch remove the adhesive strip from the wall surface;

wherein the rack assembly further comprises a cover plate removably connected with the back plate, wherein the rack is configured such that when the cover plate is connected with the back plate, the cover plate conceals the non-adhesive pull tab portion of the stretch removable adhesive strip;

and wherein the cover plate forms a notch configured to receive a portion of the support grid otherwise connected to the corresponding back plate upon assembly of the cover plate to the back plate.

* * * * *